US006185878B1

(12) United States Patent
Bullard, III et al.

(10) Patent No.: US 6,185,878 B1
(45) **Date of Patent: *Feb. 13, 2001**

(54) MODULAR PANEL CONSTRUCTION SYSTEM

(75) Inventors: Hoke V. Bullard, III; William F. Croft; Gregory S. Floyd, all of Wooster; Jonathan N. Mandell, North Canton, all of OH (US)

(73) Assignee: Rubbermaid Incorporated, Wooster, OH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/086,061

(22) Filed: May 27, 1998

(51) Int. Cl.[7] ..... A47B 47/05

(52) U.S. Cl. ..... 52/79.5; 52/36.2; 52/591.5; 52/592.3; 52/592.6; 52/731.4; 52/737.6; 52/775; 52/779; 52/781; 52/282.1; 52/282.3; 52/285.3; 52/286; 312/263; 312/264; 312/265.5; 16/382

(58) Field of Search ..... 52/79.5, 36.2, 52/591.4, 591.5, 592.2, 592.3, 592.6, 737.6, 731.4, 731.5, 775, 779, 781, 281, 282.1, 282.2, 282.3, 286, 285.3, 264, 588.1, 589.1; 312/100, 111, 263, 264, 265.4, 265.5, 109, 138.1; 16/382

(56) References Cited

U.S. PATENT DOCUMENTS

| | | | | |
|---|---|---|---|---|
| 603,147 | * | 4/1898 | Lordly | 312/265.5 X |
| 2,270,161 | | 1/1942 | Briggs . | |
| 2,981,383 | * | 4/1961 | Dunn | 52/781 X |
| 3,070,646 | | 12/1962 | Lindgren . | |
| 3,381,430 | | 5/1968 | Wiczer . | |
| 3,436,881 | | 4/1969 | Schlecht . | |
| 3,452,501 | | 7/1969 | Zimmer et al. . | |
| 3,513,608 | | 5/1970 | Nagrod . | |

(List continued on next page.)

FOREIGN PATENT DOCUMENTS

| | | | | |
|---|---|---|---|---|
| 396368 | | 11/1962 | (CH) . | |
| 2643270 | * | 3/1978 | (DE) | 52/282.2 |
| 3418687 | * | 11/1985 | (DE) | 52/264 |
| 0 359 309 A2 | | 9/1989 | (EP) . | |
| 0 359 309 A3 | | 9/1989 | (EP) . | |
| 1028791 | | 8/1950 | (FR) . | |
| 1447663 | * | 6/1966 | (FR) | 52/781 |

(List continued on next page.)

OTHER PUBLICATIONS

"item Industrietechnik" promotional materials, bearing a designation "0.4.106.31 05/95".

*Primary Examiner*—Laura Callo
(74) *Attorney, Agent, or Firm*—Foley & Lardner

(57) ABSTRACT

A utility shed is disclosed comprising modular side panels (30) which are connected together by corner connectors (26) and in-line connectors (28) to form sidewalls. The connectors (26, 28) have an I-beam cross section and comprise U-shaped ends (106, 80) which engage relatively wide channels (62, 64) to securely hold the wall panels together. A door assembly is provided for engaging the corner connectors (26) and include pivot pin members (202) which attached to the vertical channel (114) of corner connectors (26) and allow pivotal door panels (164) to be suspended therefrom. Floor panels (116, 118) and lid panels (154) are provided compatible with the I-beam edge configuration of the side panels (30) such that the lid, floor and sidewalls mutually interlock with high structural integrity. The modularity of the side panels (30) allow for enclosures of larger or smaller size to be created using the same panel componentry.

22 Claims, 18 Drawing Sheets

U.S. PATENT DOCUMENTS

| | | | | |
|---|---|---|---|---|
| 3,516,216 | | 6/1970 | Galloway . | |
| 3,543,456 | | 12/1970 | Gregoire . | |
| 3,638,385 | * | 2/1972 | Nobels et al. | 52/775 X |
| 3,640,039 | | 2/1972 | McKee et al. . | |
| 3,675,380 | | 7/1972 | Moss . | |
| 3,820,299 | | 6/1974 | Verholt . | |
| 3,854,269 | | 12/1974 | Hancock . | |
| 3,866,381 | | 2/1975 | Eschbach et al. . | |
| 3,992,839 | | 11/1976 | LaBorde . | |
| 4,258,519 | | 3/1981 | Hugens . | |
| 4,294,051 | | 10/1981 | Hughes, Jr. . | |
| 4,447,099 | * | 5/1984 | French et al. | 312/138.1 X |
| 4,557,091 | | 12/1985 | Auer . | |
| 4,652,170 | | 3/1987 | Lew . | |
| 4,805,365 | * | 2/1989 | Bastian | 52/282.2 |
| 5,036,634 | | 8/1991 | Lessard et al. . | |
| 5,155,961 | * | 10/1992 | Bardo | 52/282.2 X |
| 5,331,778 | * | 7/1994 | Mazpule et al. | 52/79.5 |
| 5,529,423 | | 6/1996 | Burke et al. . | |
| 5,575,119 | * | 11/1996 | Wolfowitz | 52/79.5 X |
| 5,647,181 | | 7/1997 | Hunts . | |
| 5,813,738 | * | 9/1998 | Cheng | 312/265.5 X |
| 5,864,997 | * | 2/1999 | Kelly | 52/282.2 |

FOREIGN PATENT DOCUMENTS

| | | |
|---|---|---|
| 1081423 | 8/1963 | (GB) . |
| 1 262 395 | 2/1972 | (GB) . |
| 2 176 514 | 12/1986 | (GB) . |
| 22203 | 7/1959 | (IE) . |

* cited by examiner

MODULAR PANEL CONSTRUCTION SYSTEM

BACKGROUND OF THE INVENTION

1. Field of the Invention

The present invention relates generally to structural panel systems combining a plurality of panel members with connector joining members to create an enclosure and, more specifically, to such systems wherein the components are modular so as to enable the construction of variably sized enclosures using the same components.

2. The Prior Art

Panel systems, or kits, comprising connector members and cooperating panels for forming a wide variety of products are well known. Applications include the construction of: building partitions and, therefrom, enclosures such as utility sheds; furniture; toy activity playsets; and containers for the storage or shipment of goods. Typically, such systems include connector members having a specific cross-sectional geometry that facilitates an engagement between such members and one or more panels having a complementary edge configuration.

A particularly common structure for the connector members in such systems is an I-beam cross-section. The I-beam defines free edge portions of the connector member which fit within appropriately dimensioned and located slots in the panel members. U.S. Pat. No. D-371,208 teaches a corner extrusion for a building sidewall that is representative of state of the art I-beam connector members. The I-beam sides of the connector engage with peripheral edge channels of a respective wall panel and thereby serve to join such panels together at right angles. Straight, or in-line, versions of the I-beam connector members are also included in the kits to join panels in a coplanar relationship, whereby creating walls of varying length.

The aforementioned systems can also incorporate roof and floor panels to form a freestanding enclosed structure such as a utility shed. U.S. Pat. Nos. 3,866,381; 5,036,634; and 4,557,091 disclose various systems having interfitting panel and connector components. Such prior art systems, however, while working well, have not met all of the needs of consumers from a structural standpoint. Paramount among such needs is a panel and connector system for creating enclosure walls which resists panel separation, buckling, racking and weather infiltration. A further problem is that the wall formed by the panels and connectors must tie into the roof and floor in such a way as to unify the entire enclosure. Also from a structural standpoint, a door system must be present which is compatible with the panel and connector sidewalls and which provides dependable pivoting door access to the enclosure.

There also commercial considerations that must be satisfied by any viable enclosure system or kit; considerations which are not entirely satisfied by state of the art products. The enclosure must be formed of relatively few component parts that are inexpensive to manufacture by conventional, cost effective fabrication techniques; and the system must be capable of being packaged and shipped in a knocked-down state. Further, the system ideally must be modular and facilitate the creation of a family of enclosures that vary in size but which share common, interchangeable components.

Finally, there are also ergonomic needs that an enclosure system must satisfy in order to achieve acceptance by the end user. The system must be easily and quickly assembled using minimal hardware and requiring a minimal number of hand tools. The system must further not require excessive strength to assemble or include heavy component parts. Moreover, the system must assemble together in such a way so as not to detract from the internal storage volume of the resulting enclosure or otherwise negatively affect the utility of the structure.

SUMMARY OF THE INVENTION

The subject invention satisfies the market's needs by providing a system, or kit, of panels and connectors which combine to form an enclosure, commonly in the form of a utility shed. The panels are formed by blow molded plastic and overlap with one another to form the sidewalls of the enclosure. A connector strip, of generally, I-beam cross section is provided to joint adjacent panels together either at the corners of the structure or inline. The connector strip forms a channel for receiving a free peripheral edge of the panel, and includes inwardly directed flanges which are received within slots of the panel. The connector strip flanges are U-shaped, filling the wide slots within the panels which are created by the blow molding process. The filling of such slots creates a tight fit between the component parts and, thereby, in the resulting structure. The overlap between vertically oriented panels and engagement between detents and detent flanges formed within the panels serve to rigidly connect the components together and counter forces that would otherwise act to separate the components or cause the components to buckle or rack.

The system further includes a door assembly comprising a plurality of pivot pin members which slide into the channel of a corner connector strip and present a vertical pivot pin on which door panels may be suspended. A roof panel and a floor panel tie together through the connector strips and sidewall panels to create mutually reinforced and unitary enclosure. The same components are used to create sheds of varying size and the assembly of the system requires minimal hardware and a minimum number of hand tools.

Accordingly, it is an objective of the present invention to provide a modular panel and connector system for creating enclosures of varying dimension using common components.

A further objective is to provide a panel and connector system which accommodates blow molding plastic formation of the panel components without degradation in structural integrity.

Yet a further objective is to provide a panel and connector enclosure in which sides, roof, and floor are integrally interlocked.

Another objective is to provide a panel and connector enclosure system having an integral door system which is readily assembled and installed.

An additional objective is to provide a panel and connector enclosure system having a minimal number of component parts and which requires minimal assembly hardware and a minimum number of assembly tools.

A further objective is provide connector members for a panel enclosure system having enhanced structural integrity and means for securely and rigidly adjoining adjacent panels.

Yet a further objective is to provide a panel and connector enclosure sidewalls which resist buckling or racking.

Another objective is to provide a panel and connector enclosure system formed of modular components useful in various enclosure configurations.

A further objective is to provide a panel and connector enclosure system which is economically and readily produced, capable of being shipped in a knock-down state, and which is easily assembled by the end user.

These and other objectives, which will be apparent to one skilled in the art, are achieved by a preferred embodiment which is described in detail below and illustrated by the accompanying drawings.

DESCRIPTION OF THE ACCOMPANYING DRAWINGS

Figure 10:
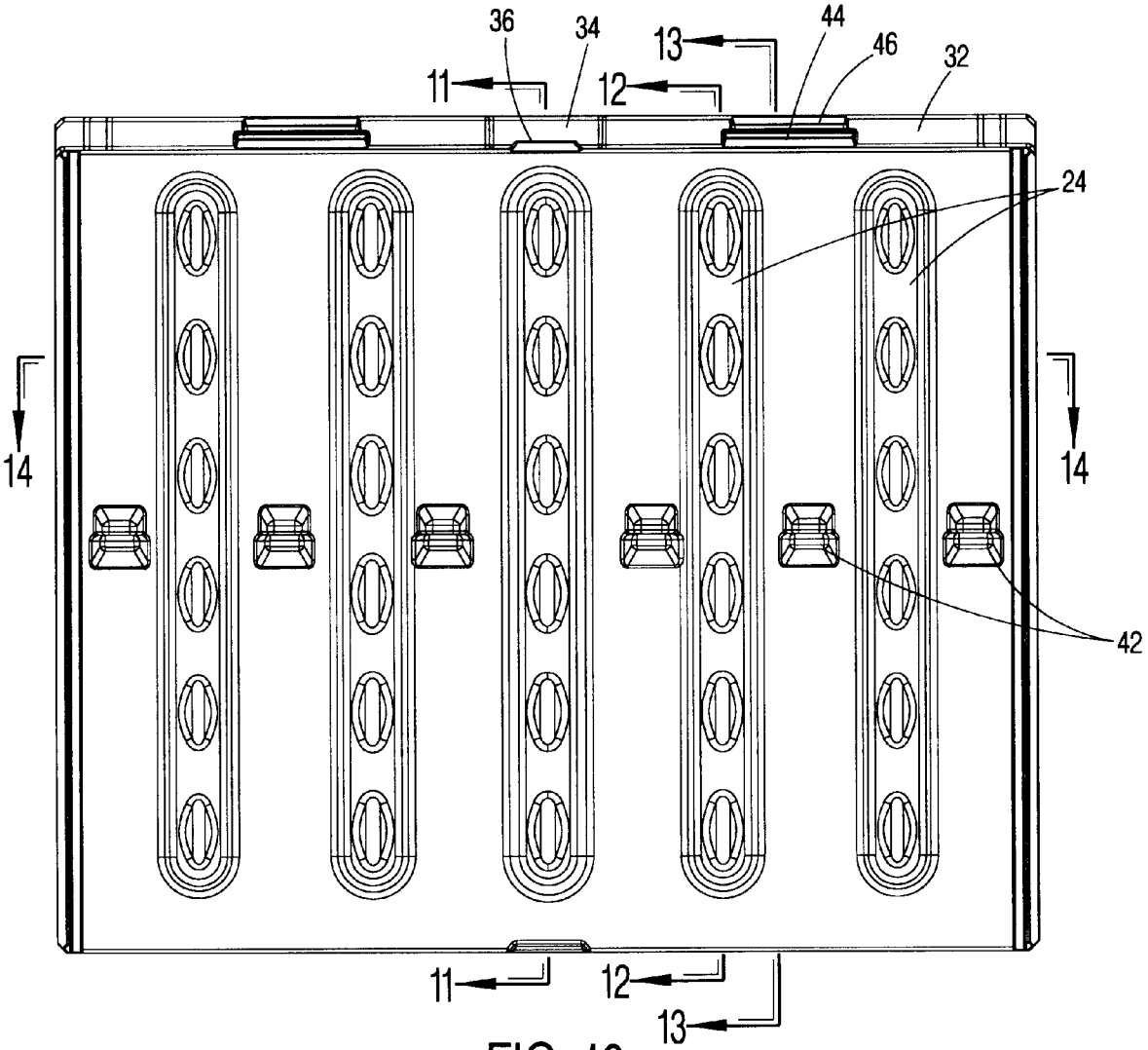

FIG. 10. is rear plan view of a side panel.

Figure 11:
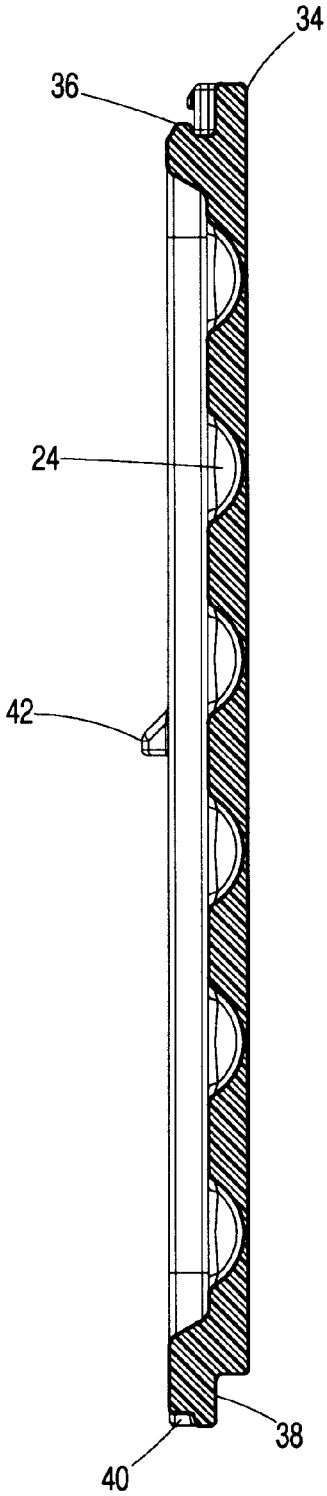

FIG. 11 is a transverse section view through a side panel taken along the line 11—11 of FIG. 10.

Figure 12:
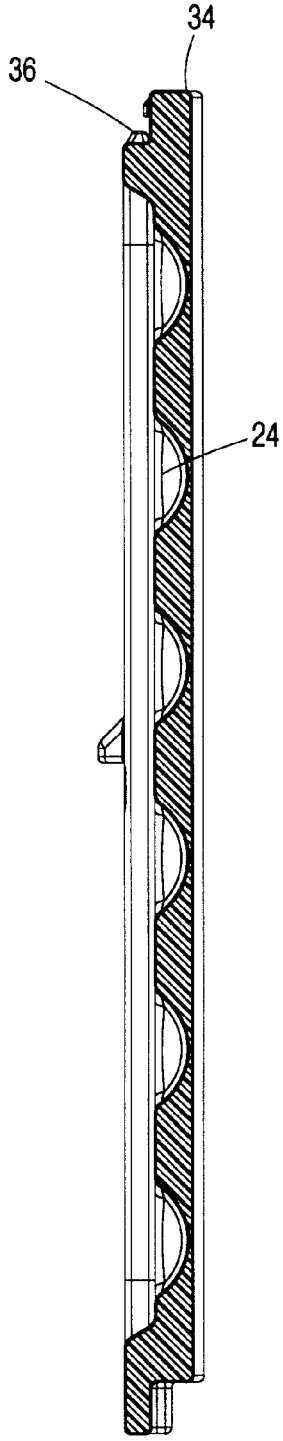

FIG. 12 is a transverse section view through a side panel taken along the line 12—12 of FIG. 10.

Figure 13:
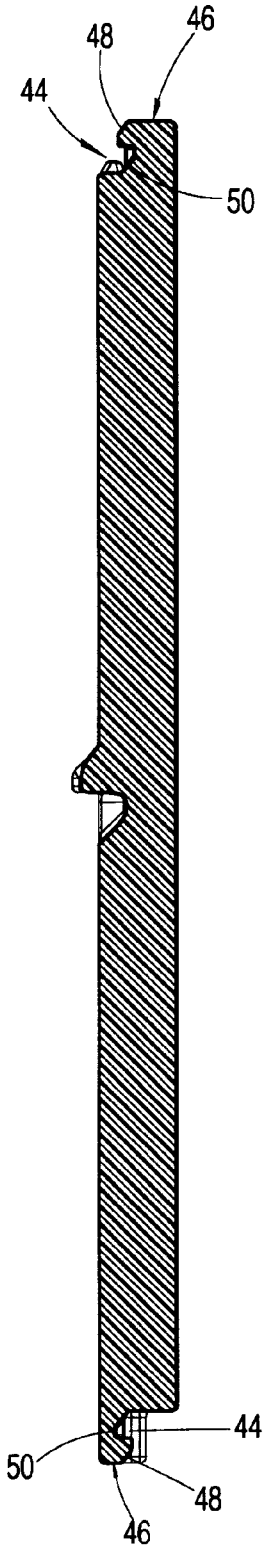

FIG. 13 is a transverse section view through a side panel taken along the line 13—13 of FIG. 10.

Figure 14:
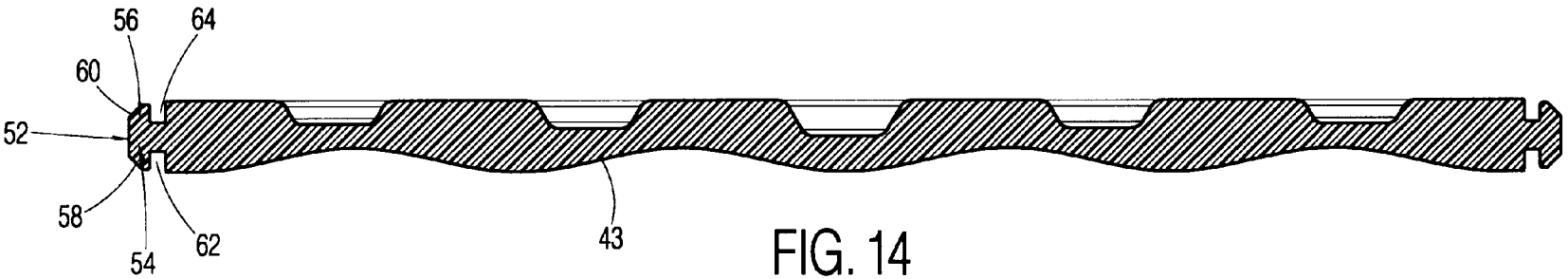

FIG. 14 is a longitudinal section view through a side panel taken along the line 14—14 of FIG. 10.

Figure 15:
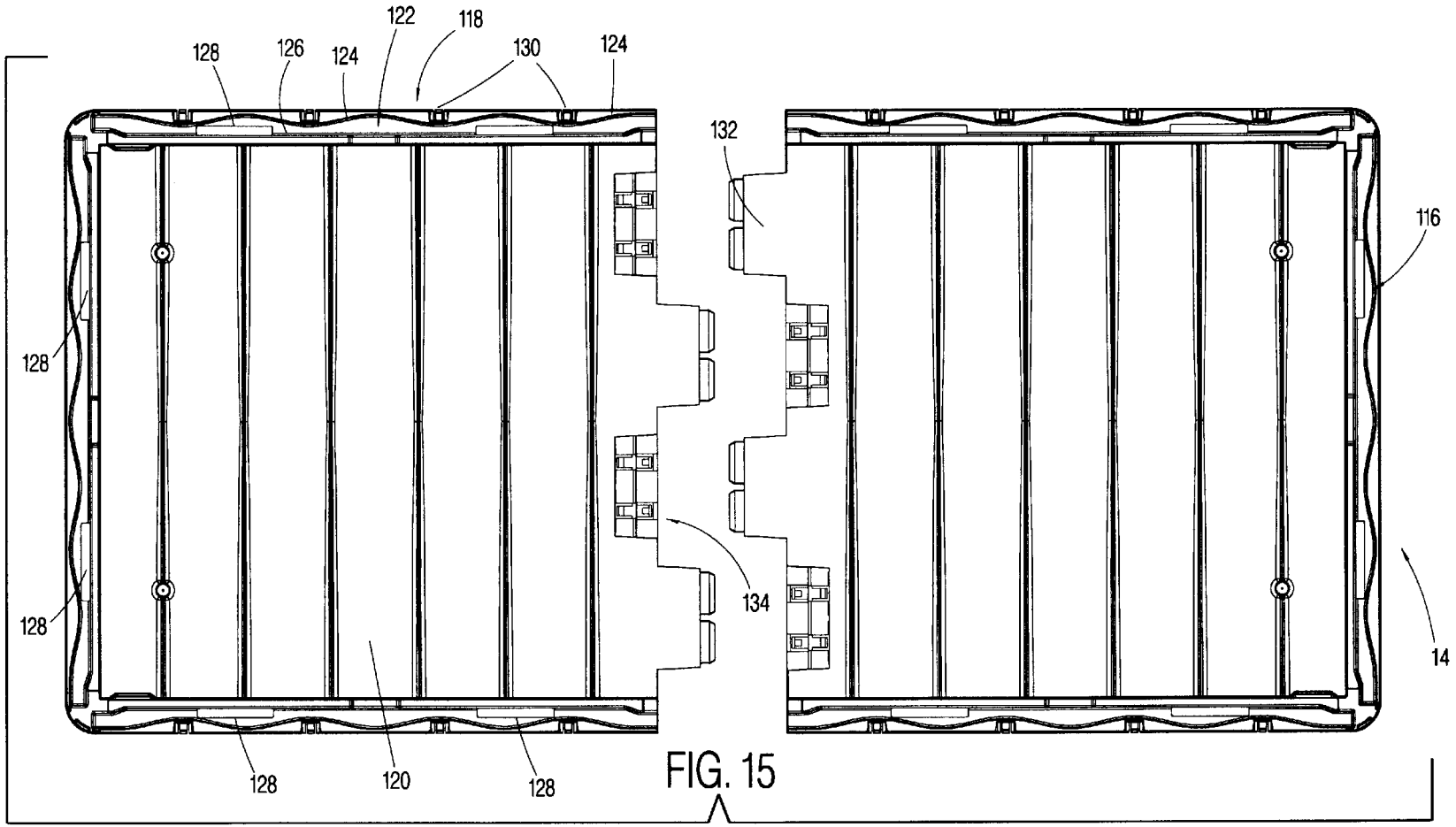

FIG. 15 is a top plan view of two mating floor panels.

Figure 16:
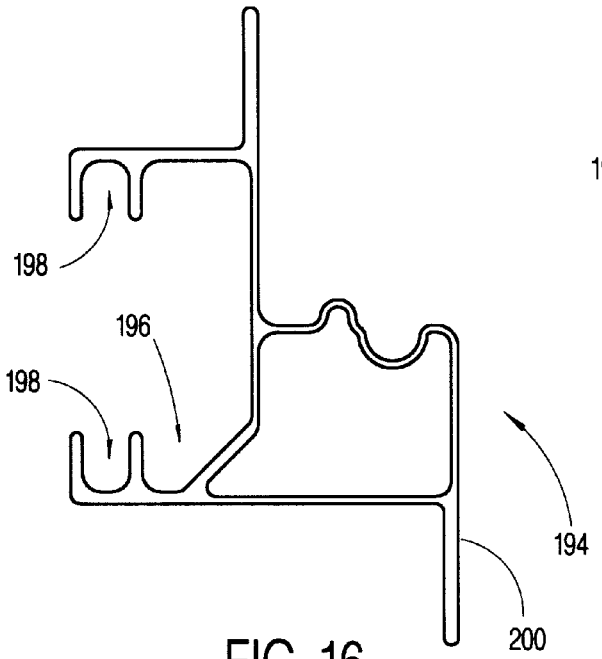

FIG. 16 is a transverse section view through a door panel edge strip.

Figure 17:
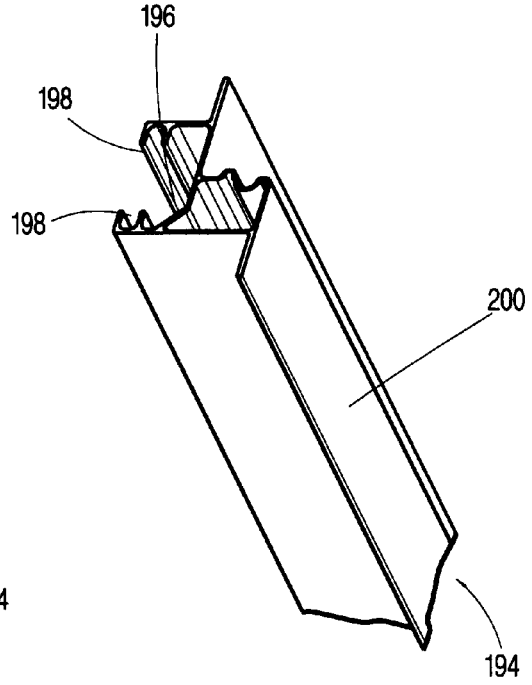

FIG. 17 is a perspective view of a partial door panel edge strip.

Figure 18:
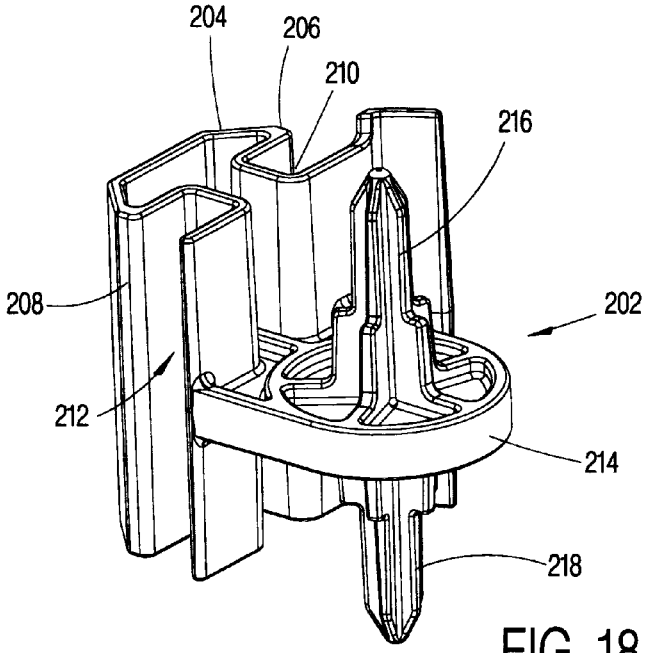

FIG. 18 is a perspective view of a door pivot pin member.

Figure 19:
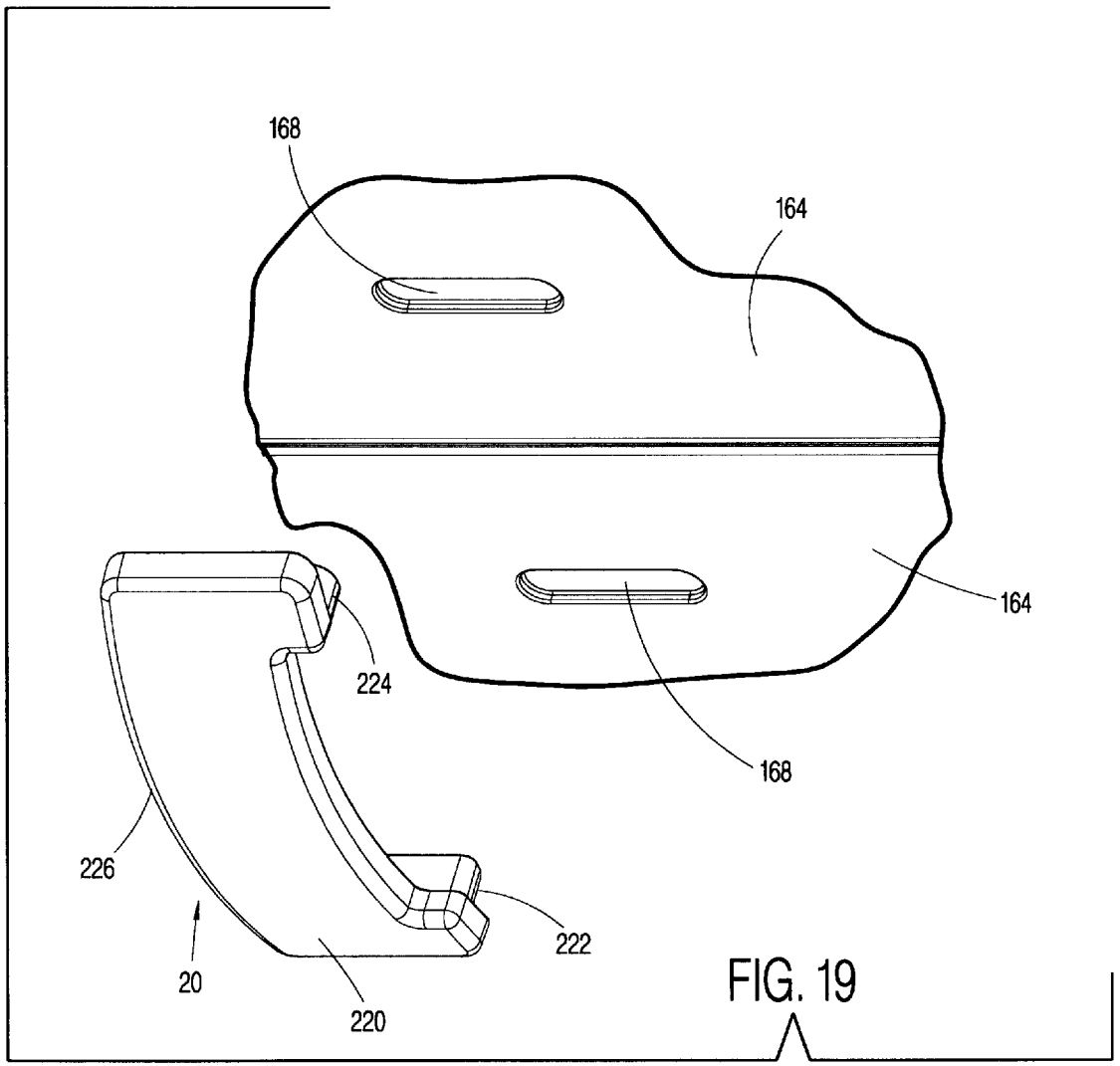

FIG. 19 is an enlarged fragmentary perspective view of a door handle and door panel.

Figure 20:
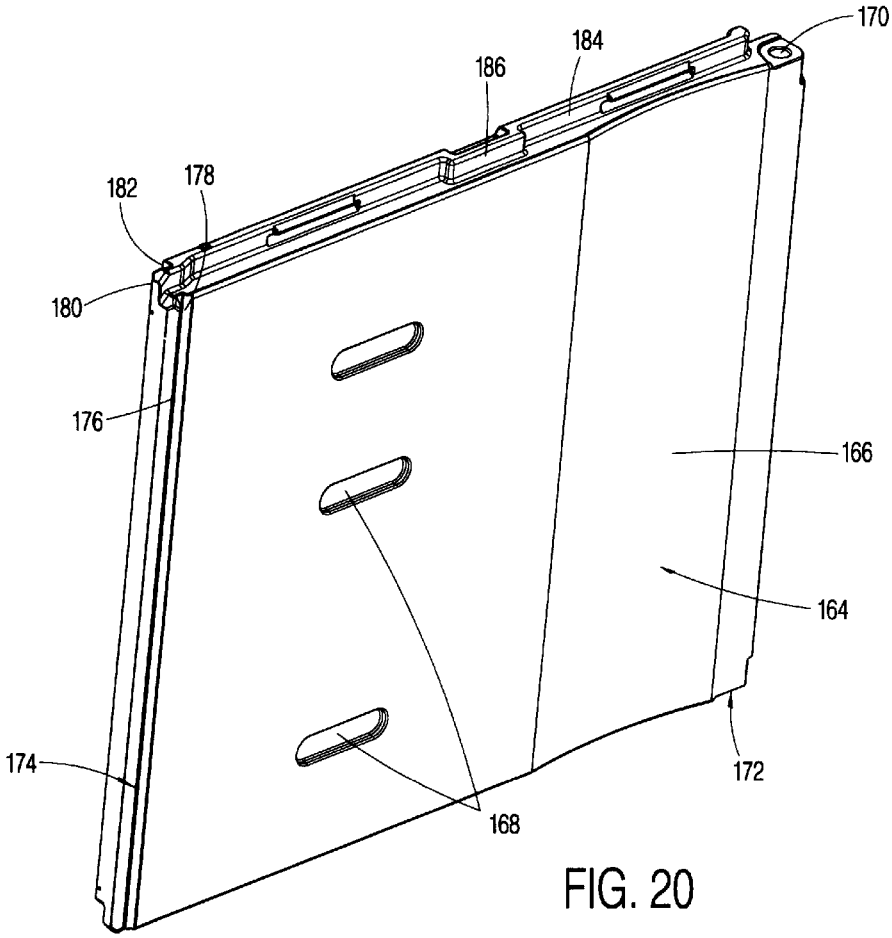

FIG. 20 is a front perspective view of a door panel.

Figure 21:
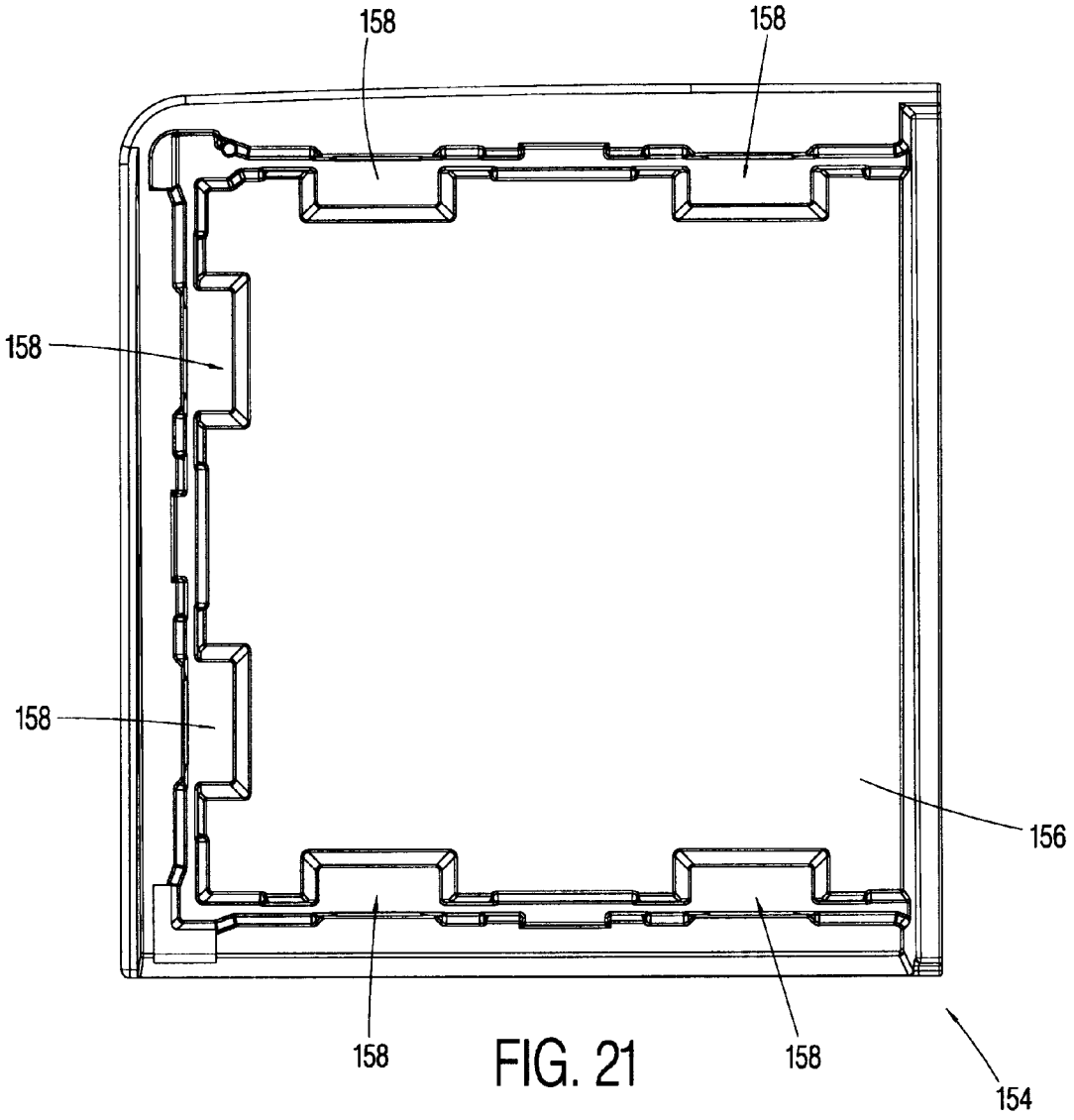

FIG. 21 is a top plan view of a roof panel.

Figure 22:
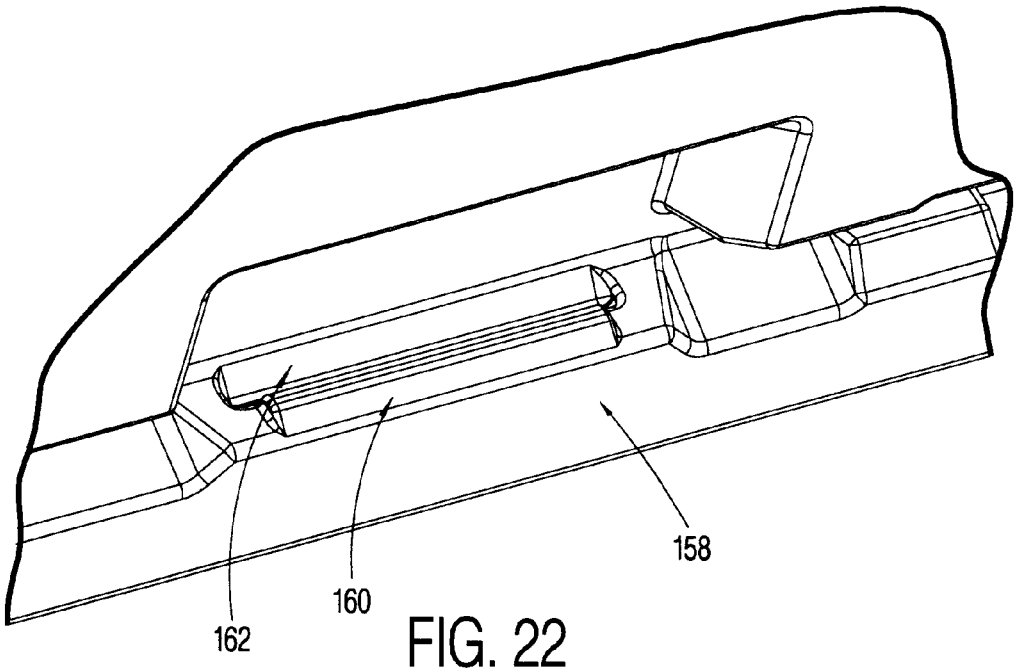

FIG. 22 is a front fragmentary perspective view of a roof panel.

Figure 23:
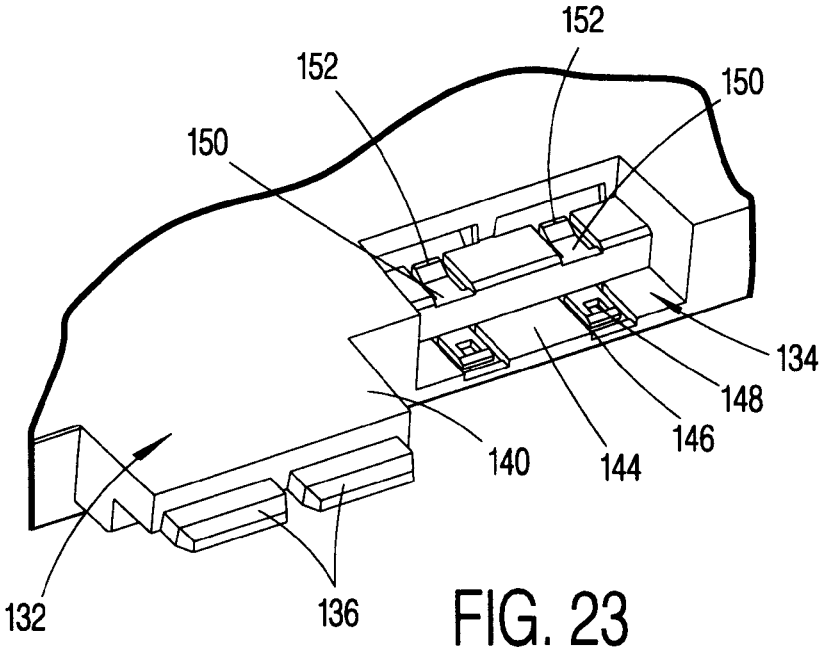

FIG. 23 is a front top fragmentary perspective view of the floor panel overlap joint.

Figure 24:
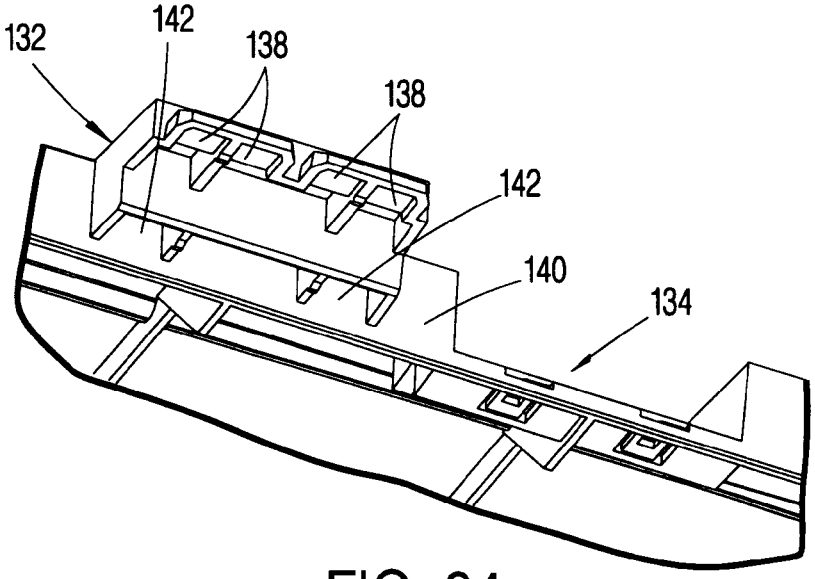

FIG. 24 is a front bottom perspective view of the floor panel overlap joint.

Figure 25:
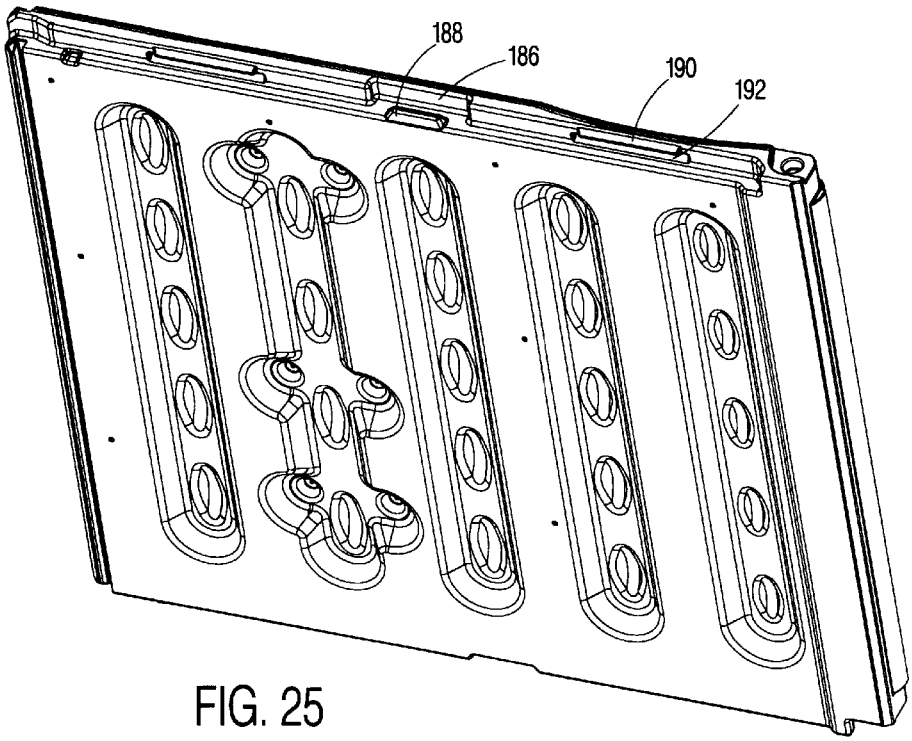

FIG. 25 is a rear perspective view of the door panel.

Figure 26:
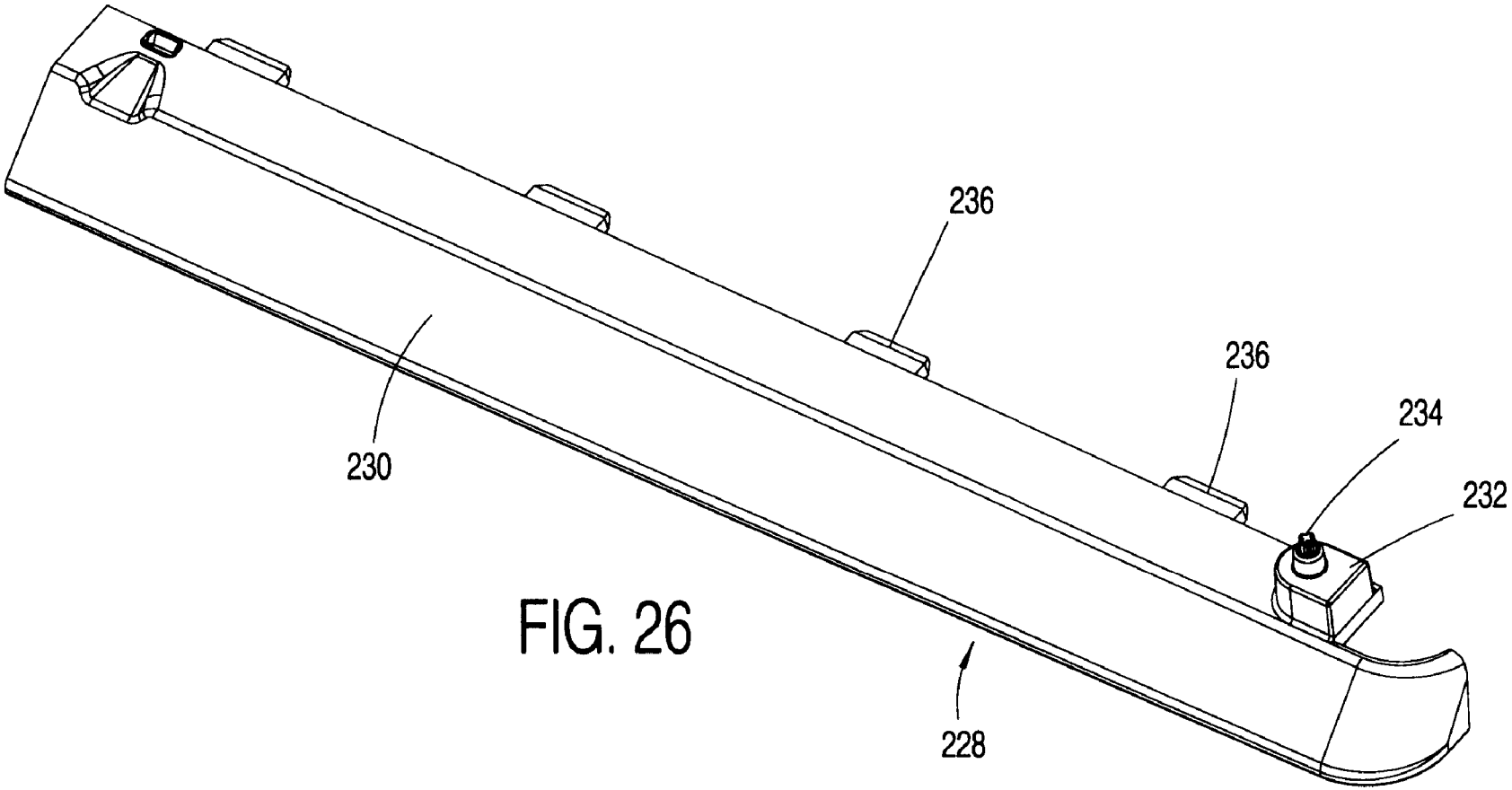

FIG. 26 is a front perspective view of the front nose strip.

DESCRIPTION OF THE PREFERRED EMBODIMENT

Figure 1:
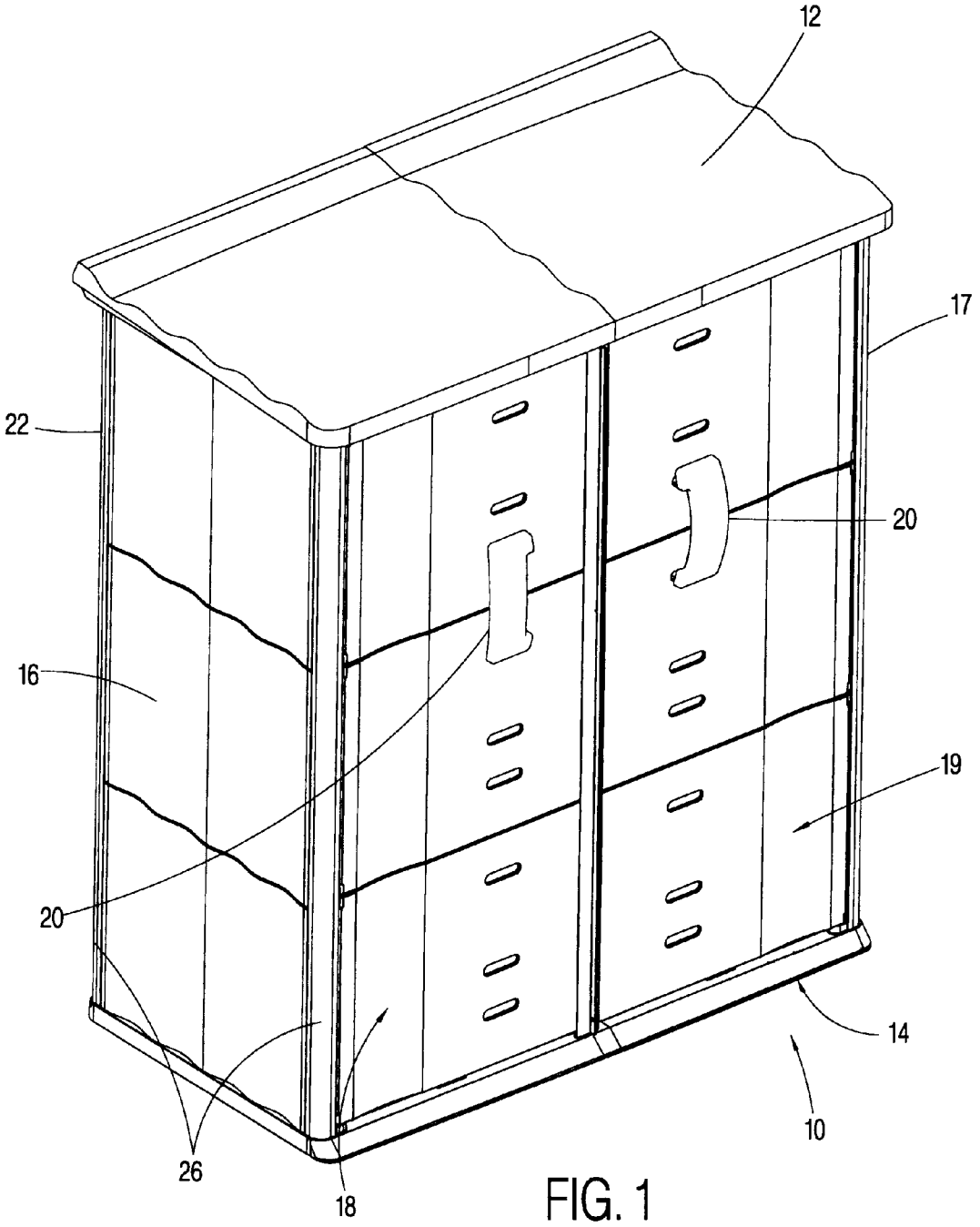
FIG. 1 is a front perspective view of a utility shed incorporating the subject panel and connector system.
Figure 2:
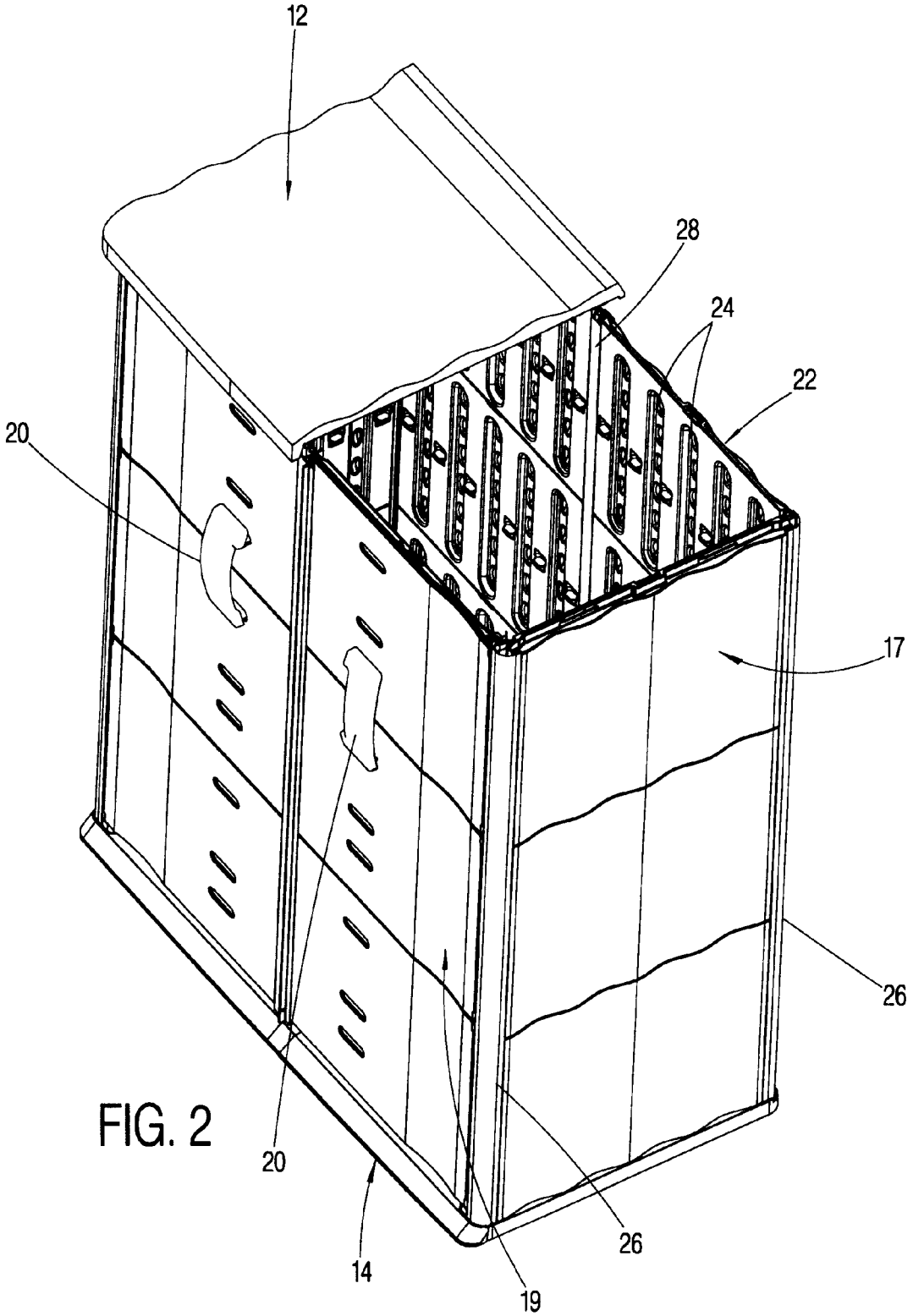
FIG. 2 is a front top perspective view thereof with one of the roof panels removed.

Referring initially to FIGS. 1 and 2, the subject invention is shown embodied in the form of a utility shed enclosure 10, comprising a top panel assembly 12, a floor assembly 14, opposite side assemblies 16, 17, adjacent door assemblies 18, 19, a pair of handles 20, and a back panel assembly 22. In the preferred embodiment, the panels are formed of conventional plastic such as polyethylene, through the process of blow molding conventional in the industry. The result is that the panels comprising the sides, lid, floor, and doors of the subject shed 10 are hollow and have a relatively thick dimensional section. Elongate depressions 24 are formed within the inner surfaces of such panels in order to enhance the rigidity of the panels while leaving the external surface in a smooth condition for aesthetic purposes, as shown in FIG. 2.

The subject system further includes a plurality of elongate corner connectors 26 and a plurality of in-line, or straight, connectors 28. The connectors 26 and 28 may be formed of suitable conventional plastics material such as polyethylene, or other suitable plastic, by either an extrusion molding process or by injection molding.

Figure 9:
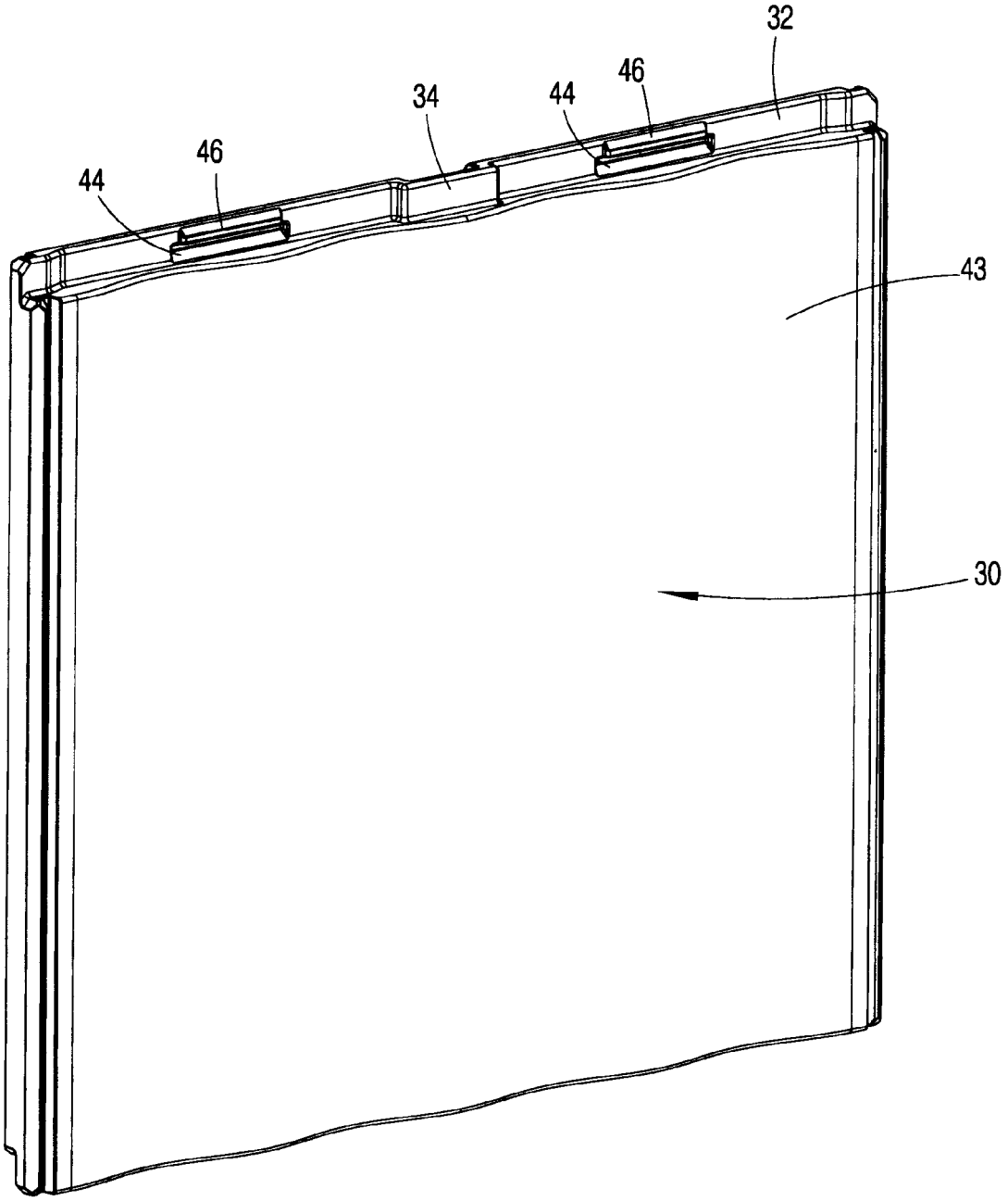
FIG. 9 is a front plan view of a side panel.

Referring to FIGS. 9, 10 and 11, one side panel 30 is shown. Side panel 30 constitutes one of a plurality of like-configured panels in the system and represents a central building block in the formation of the sides and back panel assemblies. The side panel 30 is configured to overlap and mate on the top and bottom with other like-configured panels, and comprises an upper overlap flange 32 for such purpose. The flange 32 steps inward as a protrusion 34 at a location midway across, and an elongate male detent flange 36 is formed within the protrusion 34 and projects upwardly. A complimentary overlap flange 38 is formed along a bottom edge of the panel 30 and provides a detent 40 positioned midway across, dimensioned to receive the male detent flange 36 of a like-configured second panel. A ledge protrusion 42 extends from a central location on an inward surface of the panel 30, and provides with protrusions of other side panels, support for a shelf (not shown).

Continuing with regard to FIGS. 9, 10 and 11, the outer surface 43 of the panel 30 is convoluted or rippled for added strength. A pair of elongate detent recesses 44 are provided within the top overlap flange 32, located on opposite sides of the protrusion 34. Positioned above and extending along the detent recesses 44 are detent ribs 46. In the lower overlap flange 38, complimentary located and configured recesses 44 and interlocking detent flanges, or ribs, 46 are incorporated. The flanges 46 have a beveled lead in surface 48 along an outward side and a flat stop surface 50 formed along an inward side.

It will be appreciated that the purpose of the protrusion 34 is to align two panels together vertically to facilitate their mechanical connection. The panels, so aligned, are brought into overlapping relationship as the top overlap flange 32 of one panel overlaps the lower overlap flange 38 of the other. The detent flange 36 of the lower panel enters into the detent 40 of the superior panel. Likewise, the detent ribs 46 of the lower panel upper flange 32 ride over the ribs 46 in the upper panel lower flange 38 and into detent recesses 44 therein. The result is a mechanically secure connection between the two panels.

The overlap joint between panels so aligned and connected as described above provides a secure connection and offers several advantages. First, the overlap prevents rain from entering the enclosure from between top and bottom panels. Secondly, the ramped lead in surface 48 on locking flange rib 46 easily rides over the rib 46 of the second panel, minimizing the force require by the user to effect clearance. As rib 46 enters appropriately into the channel 44 of the opposite panel, flat surface 50 of the rib abuts flat surface 50 of the opposite rib. This creates a positive lock and prevents inadvertent separation of the panels. The detent channels 44 and detent rib flanges 46 prevent separation of the panels from tensile forces and also prevent in-plane rotational movement of one panel relevant to the other.

The engagement between bumps or detent flange s 36 of one panel into detent 40 of the opposite also acts to secure the connection between panels. Also, the engagement keeps the panels in the same plane and prevents bowing of either panel. The protrusion 34 of one panel aligns against the protrusion 34 of the opposite panel and serves to reinforce the connection against racking, or transverse movement of one panel relative to the other. Thus, from the above, it will be appreciated that the structural overlap and redundant detent and detent flange connections between the panels effects resistance to undesirable movement of one panel to the other in any direction. That is, separation in transverse or longitudinal directions is prevented, as is rotational movement and bowing deformation of either panel. The resultant wall created by the combination of interlocking panels as taught herein accordingly benefits from a high structural integrity.

Figure 5:
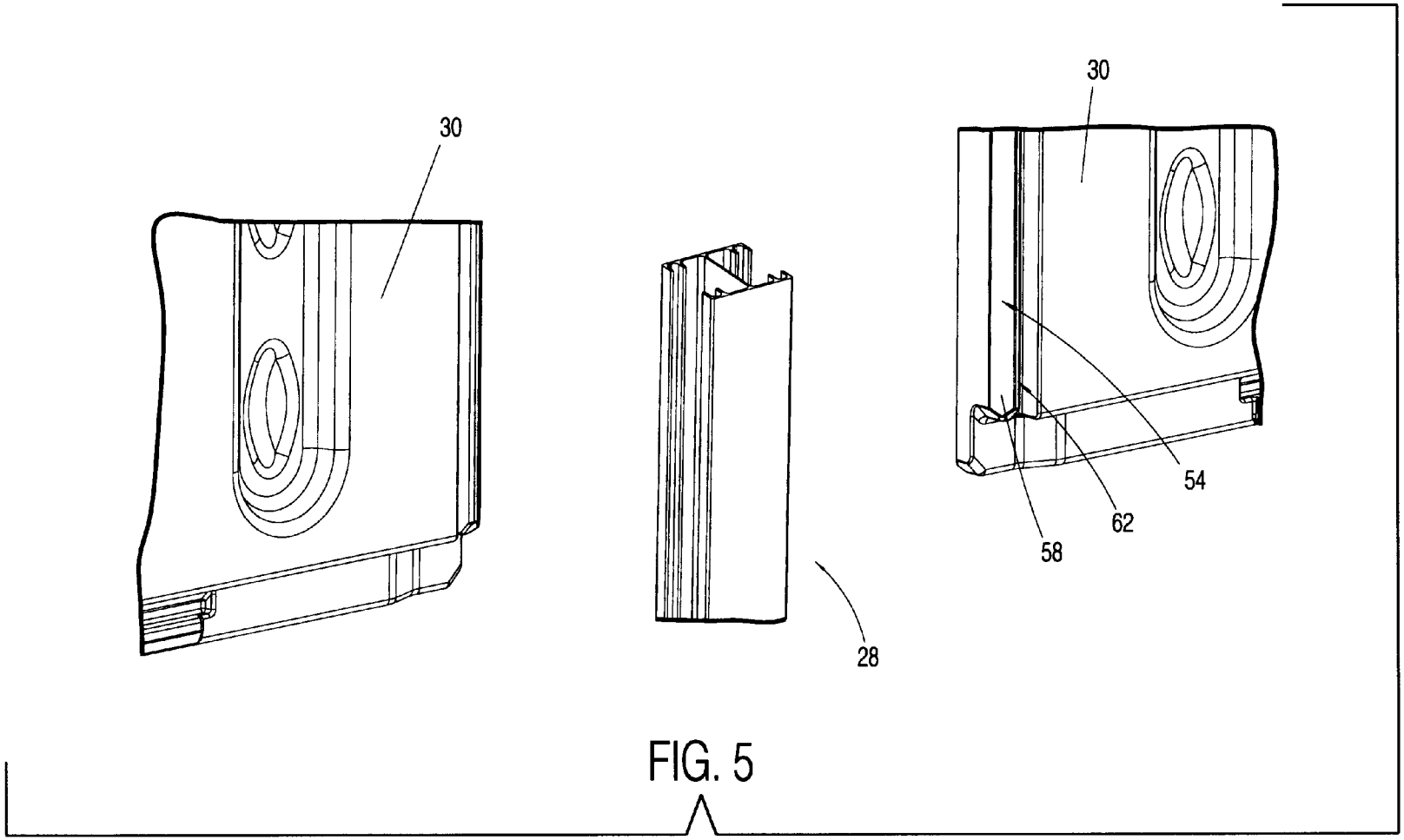
FIG. 5 is an exploded fragmentary perspective view of a straight connector and two panels which are joined thereby.
Figure 6:
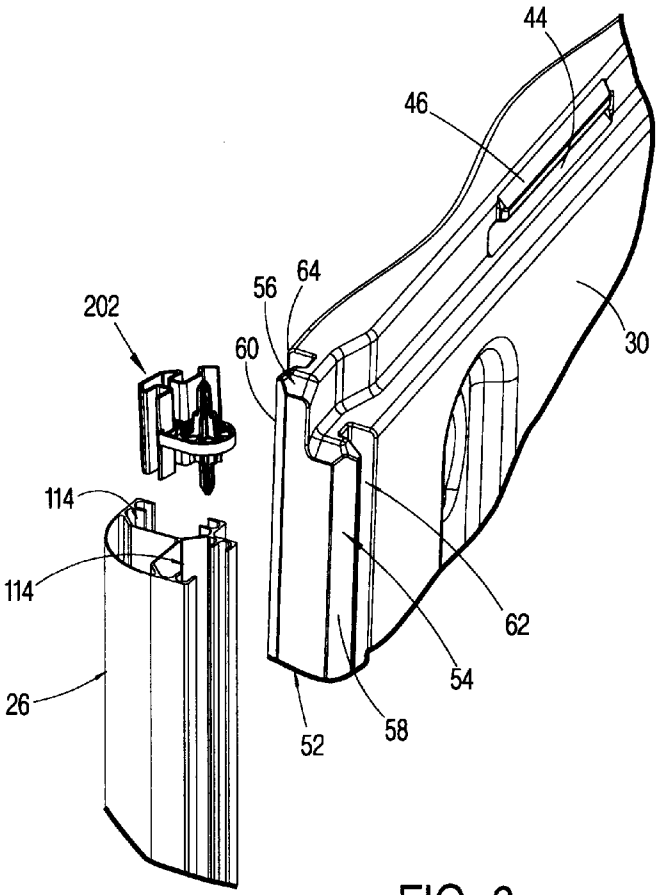
FIG. 6 is an exploded fragmentary perspective view of a corner connector, panel, and a pivot pin member.

Referring to FIGS. 5, 6 and 14, the peripheral lateral edge of each panel member 30 further is structured to provide an I-beam sectional configuration. Edge flanges 54, 56 extend from opposite sides of the panel 30 from top flange 32 to bottom overlap flange 38. Beveled surfaces 58, 60 of extend along leading sides of the flanges 54, 56. A pair of channels 62, 64 extend adjacent flanges 54, 56, respectively. The process of blow molding panel member 30 from plastics material requires that the channels 62, 64 be relatively wide, approximately as wide as deep.

Figure 3:
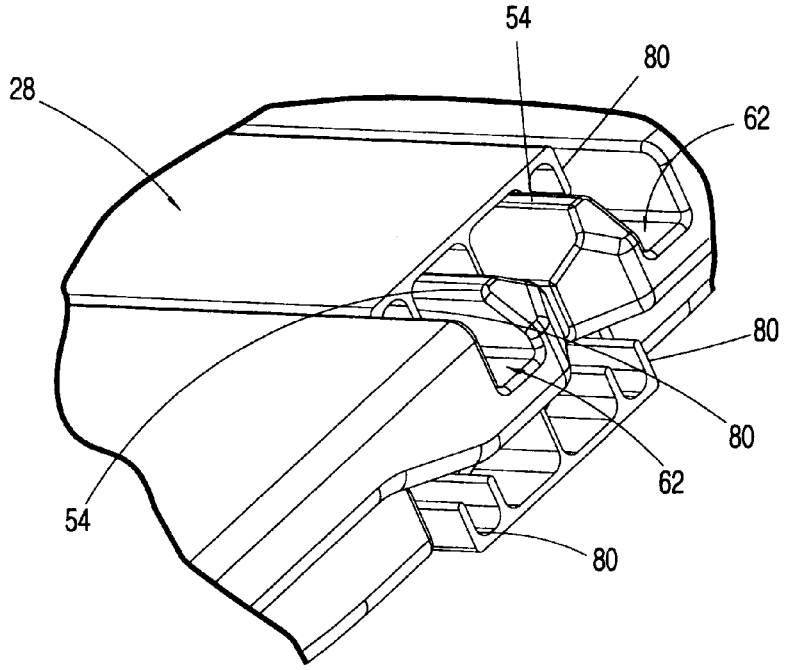
FIG. 3 is an enlarged fragmentary perspective view of a straight connector and two panels connected thereby.
Figure 8:
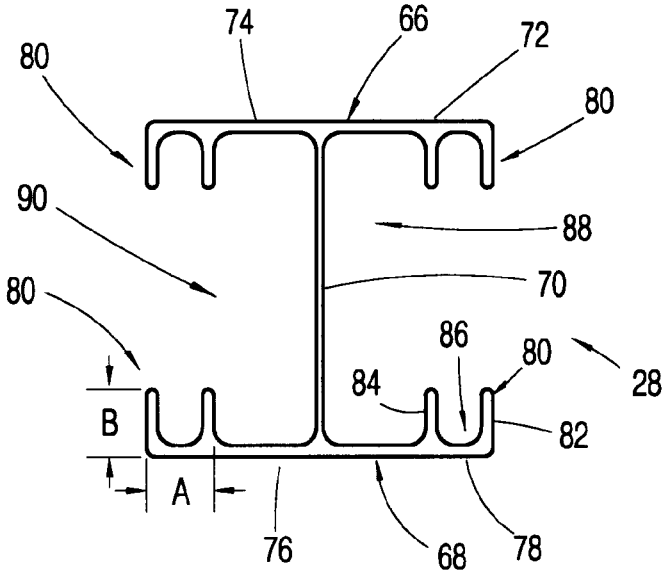
FIG. 8 is a cross-sectional view through a straight, or in-line, connector.

The connector members which comprise component parts of the subject system will be understood from a consideration of FIGS. 3, 5 and 8. A straight, or in-line, connector 28 is shown as having, essentially, an I-beam cross-sectional configuration. The connector 28 comprises parallel side walls 68 bisected by a transverse divider wall 70. Arms 72, 74, 76 and 78 are thus defined to extend from divider wall 70, each arm terminating in an inward directed U-shaped end 80. Each U-shaped arm end 80 is defined by an outer flange 82 and an inner flange 84, separated by a bight channel 86. It will be appreciated that the width dimension "A" of U-shaped end 80 is preferably approximately equal to the depth dimension "B", as shown in FIG. 8 as a result of the blow molding process. A pair of elongate channels 88, 90 are, accordingly, defined along each connector 66 on opposite sides of the divider wall 70. Each channel 88, 90 is partially enclosed along an outward side by the inward directed U-shaped ends 80 of respective arms which define the sides of the channels 88, 90.

Figure 4:
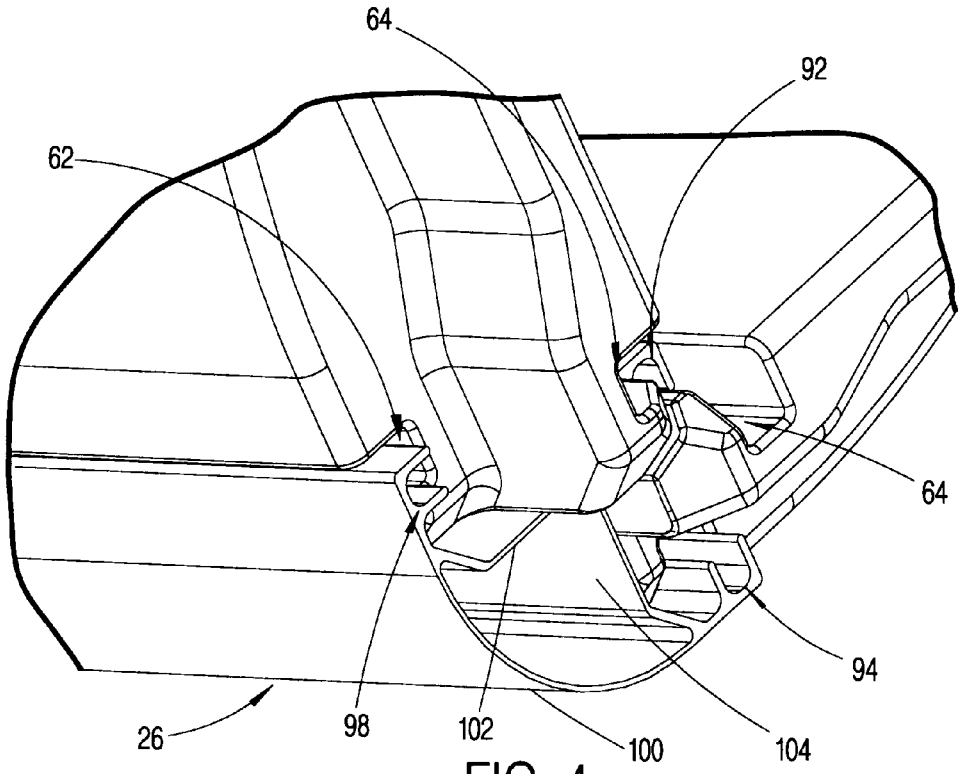
FIG. 4 is an enlarged fragmentary perspective view of a corner connector and two panels connected thereby.
Figure 7:
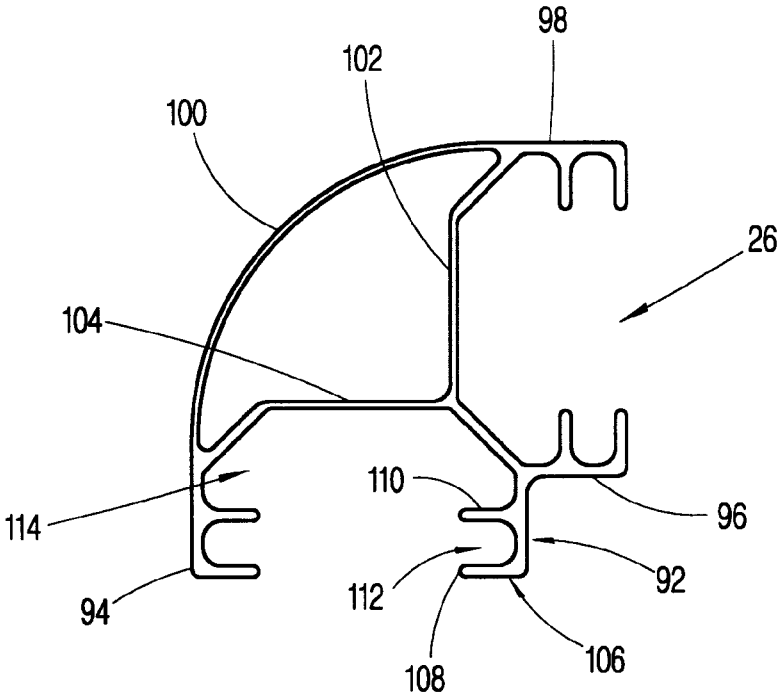
FIG. 7 is a cross-sectional view through a corner connector.

FIGS. 4 and 7 best show the configuration of the corner or right angle connector 26, which takes the general cross-section of two I-beams intersecting at a right angle. Connectors 26 include spaced apart and parallel side walls 92, 94 extending in a first direction and spaced apart and parallel side walls 96, 98 extending at a right angle to the first direction. a curved outer wall 100 connects the two I-beam components of connector 26. An inner wall 102 defines with the side walls 96, 98 a channel 114 and an inner wall 104 defines with the sidewalls 92, 94 a like channel 114 on the opposite side. The side walls 92, 94, 96, 98, similar to the straight connector 28, have inward directed U-shaped ends 106, each defined by an outward flange 108 and an inward flange 110 separated by a bight channel 112. The relative depth to width dimension of U-shaped ends 106 to the corner connector 26 is the same as described above in reference to the straight connector 28.

The connectors 26, 28 serve to join side panels 30 to form the side wall assemblies 16, 17 and back assembly 22. It will be seen from FIGS. 1, 2, 3 and 4, that, for the size enclosure represented therein, the side walls comprise three stacked side panels 30 and the back assembly 22 comprises six panels 30. The side wall assemblies 16, 17 are formed by sequentially feeding the I-beam peripheral edges 52 of three panels 30 into the channels of two corner connectors 26. The channels 114 of connectors 26 are sized to receive edges 52 as U-shaped ends 106 of connector 26 enter into the channels 62, 64 of the edges 52. The opposite panel edges 52 of the first side panel 30 are fed downward into the connector channels 114 of two connectors 26 to the bottom. Thereafter, the second of three side panels 30 is fed downward into the connector channels 114 to an overlapping engagement with the first panel 30. The engagement between overlapping panels and their respective detent flanges and detents is as described previously. The third panel 30 is assembled in like manner until all three panels of one side of the enclosure are in overlapping formation.

Assembly of the back assembly 22 proceeds in like manner except that one edge 52 of three panels 30 are assembled in overlapping formation to one connector 26 and the opposite edge 52 of the panels are assembled into a connector 28. The connector 28 thus acts to double the length of the back wall relative to the side wall of the enclosure. It will be appreciated that the U-shaped ends 106 (connector 26) and 80 (connector 28) are wide enough to substantially fill the relatively wide channels 62, 64 in the panel edges 52. The U-shaped configuration thus effects a tight fit between the connectors and the side panels 30. Moreover, material used in the formation of the U-shaped ends is substantially less than would otherwise be necessary were the ends of the connector arms made of solid material to a thickness equivalent to the width of channels 62, 64. The subject connectors 26, 28, accordingly, effectuate a positive connection to relatively wide channels which are a natural consequence of the blow molding process, yet do so in a cost effective manner.

Referring next to FIGS. 15, 23 and 24, the subject enclosure includes a pair of identical floor panels 116, 118. Panels 116, 118 are configured identically. Each panel 116, 118 has a top surface 120 and a peripheral channel 122 extending about three sides. Channel 122 is defined along an outer side by a serpentine mating upright flange wall 124 and along an inward side by flat vertical wall 126. Six locking flanges, each dimensioned and configured identically to the locking flanges 46 of the side panels 30, are positioned about the periphery of the panels 116, 118 within the channel 122. A series of spaced apart edge apertures 130 extend through each panel 116, 118 to the outside of flange wall 124. Positioned along and extending forward from each of the panels 116, 118 are spaced apart finger flange projections 132 with adjacent projections 132 being separated by recesses 134. As best seen from FIGS. 23 and 24, each projection 132 has a pair of flange protrusions 136 extending therefrom, and a each protrusion 136 is formed having a pair of sockets 138 in an underside. The body 140 of projections 132 further has two additional sockets 142 formed in an underside.

A ledge 144 is formed inside each recess 134 and a pair of spaced apart sockets 146 are formed therein. Each socket 146 has a detent flange projecting upward therefrom. Stepped above the ledge 144 within each recess 134 is a second pair of sockets 150, each likewise having a detent flange 152 which projects upward therefrom. It will be appreciated that the floor section panels 116, 118 mateably engage as the projections 132 of the one fit within and overlap the recesses 134. The detent flanges 148 of the underlying recess resiliently snap into the sockets 142 of the upper panel and the detent flanges 152 resiliently snap into the sockets 138. The panels 116, 118 are thus secured together in an interfitting engagement and their respective top surfaces 120 are coplanar.

The side assemblies 16, 17 are attached to the interconnected floor panels 116, 118 by inserting the lower edge of the side panel 30 into the channel 122 of the floor. The shape of the outer surfaces of the side panels 30 align against the shape of the outer wall 124 of channel 122 and the flat inward surface of the side panels 30 against flat channel wall 126. The detent flanges 128 of the panels 116, 118 align with and extend over the locking detent flanges 46 of the side panels and ride over such flanges into the detent channels 44 located thereabove. The result is a positive mechanical connection between the preassembled wall side assemblies 16, 17 and the floor surface.

Continuing with reference to FIGS. 21, 22, each lid panel 154 is shown to comprise a generally flat tack off bottom surface 156. A series of six sockets 158 of generally rectangular shape extend into the surface 156, positioned two to a side. The detail of each socket 158, as best seen in FIG. 22, includes a detent flange 160 configured and dimensioned identically with the locking detent flanges 46 of the side panels 30. Positioned adjacent each flange 160 is a detent channel 162 correspondingly sized and configured as channels 44 of the side panels 30. It will be readily understood that the side panel assemblies 16, 17 interconnect along their upper overlap edge flange 32 into the lid panels 154 in like manner as panel assemblies 16, 17 interconnect along their lower overlap edge flange 38 into the floor panels 116, 118. That is, the locking detent flanges 46 along the upper side panel 30 engage over the detent flange 160 of each socket 158 until entering into the channel 162. Accordingly, the side assemblies 16, 17 are mechanically connected simultaneously into the lid panels and the floor panels. The resultant enclosure is structurally tied together as floor and lid panels both connect in with the opposite top and bottom edges of the side assemblies 16, 17.

The enclosure representing the preferred embodiment is configured having two door panels 164, each being configured as the mirror image of the opposite. While one panel is represented in FIGS. 20, 25, it will be readily appreciated that the other panel member (not shown) is of identical mirror configuration. The panel 164 is configured having a flat front side 166 into which a series of oval, spaced apart handle depressions 168 are formed. FIG. 20 shows the panel 164 in an inverted condition. An upper pivot pin bore 172 is formed at the upper left hand corner of the panel 164 and a lower pivot pin bore 170 is formed at a lower left hand corner. A free leading edge 174 of the door panel 164 is opposite the pivot pin bores 170, 172 and is substantially of I-beam cross sectional configuration. Formed along an outward surface of panel 164 proximate edge 174 is an elongate, outward projecting detent flange 176 extending from top to bottom. Adjacent flange 176 and co-extensive therewith is a detent channel 178. Opposite flange 176 and channel 178 on the opposite side of the edge 174 are detent flange 180 and detent channel 182. The I-beam edge 174 extends to an upper overlap flange 184.

The flange 184 at the top of the door panels 164 is substantially configured as the top flange 32 of each side panel 30 described previously. The flange 184 has a rectangular protrusion 186 midway across and a detent projection 188 therein. A locking detent flange and detent channel 190, 192, respectively, are on opposite sides of the protrusion 186.

The forward edge 174 of the door panel 164 is intended to engage a edge strip 194 as will be apparent from FIGS. 16, 17. The edge strip 194 is fabricated by extrusion or injection molding and has one side of substantial I-beam cross section with which to engage door panel edge 174. A channel 196 is formed and is enclosed partially across an outer side by U-shaped ends 198 in like manner to connectors previously described. The strip 194 provides a flat surface 200 at the side opposite the I-beam for abutting against a like-configured surface 200 of the opposite door panel. The strip 194 is reversible such that it can be used on both the right and left door panels 164, whereby avoiding the cost of a separate part for each door side.

A pivot pin member 202 is shown in FIGS. 6 and 18 intended to attach to the front corner connectors 26 of the enclosure and to pivotally suspend the door panels 164, both right and left, therefrom. The member 202 is configured at one side 204 to have a generally I-beam sectional configuration dimensioned and adapted to allow member 202 to slide down channel 114 of the corner connector 26. The I-beam section is defined by oppositely extending detent flanges 206, 208 and channels 210, 212 adjacent thereto, respectively. The member 202 further includes a generally circular horizontal flange 214 extending from side 204. An upward extending pivot pin 216 and a depending pivot pin 218 extend from the flange 214. Pivot pin member 202 is integrally formed of conventional plastic material, preferably by the injection molding process. Pin members 202 can be interchangeably used on either the right or the left door panels.

The handle body 220 of the enclosure is represented in FIG. 19. The body is generally concave and rectangular and includes a mounting boss 222, 224 at opposite end adapted to fit within respective ones of depressions 168 in the door panels 164. Thereupon, screws (not shown) may be inserted through the bottom surface of depressions 168 and into the handle bosses 222, 224 to attach the handle securely to the door. An outer edge 226 of the handle body 220 provides the user with an edge for grasping the handle to open the door.

A front nose member 228 is shown in FIG. 26. A member 228 mounts to a forward side of each of the floor panels 116, 118. Member 228 comprises a ramped forward surface 230 and a raised support boss 232 at an outward end. Extending upwardly from the support boss 232 is a pivot pin 234. A series of four attachment finger flanges 236 are spaced along and extend outward form a rear side of the nose member 228. It will be apparent from FIG. 15 that the finger flanges 236 of member 228 are positioned to align with the edge apertures 130 of floor panels 116, 118 and include detent flanges (not shown) in an undersign which snap through the apertures 130 and securely affix nose member 228 to the floor panels 116, 118.

Assembly of the door to the enclosure will appreciated from FIGS. 6, 18, 20, and 26. A first door panel 164 is aligned with the edge of a forward corner connector 26 and lower pivot pin bore 170 of the panel 164 is lowered onto the upwardly directed pivot pin 234 of the nose member 228. Thereafter, one of the pivot pin members is inserted into the same corner connector 26 from the top and slid down in the I-beam channel until the lower pin 218 enters the top bore 172 of the first panel 164. A second panel is then aligned with the same corner connector 26 and lower bore 170 receives the upper pin 216 of the pivot pin member. A second pivot pin member 202 follows into the connector 26 until received within the second panel 164. A third and final panel 164 is then aligned with the connector 26 and receiving the upper pin 216. A third and final pin member 202 is inserted into the top bore 172 of the third panel and the top pin 218 thereof is captured within the top lid panel. The edge extrusion 194 is then assembled to the door forward edge as channel 196 receives the forward edges of panels 164 therein. Extrusion 194 assists in holding the three stacked door panels 164 together. In the preferred embodiment, three panels 164 and three pivot pin members 202 are deployed per door side.

So assembled, the door assembly is supported by the pivot pin 234 of the nose member 228 and the three of pivot pin members 202 to freely pivot thereabout. The door members may thus be freely opened and closed at both sides of the enclosure.

From the foregoing, it will be understood that the subject invention is composed of modular components. For the size structure depicted in the preferred embodiment, as shown in FIGS. 1 and 2, the sides of the utility shed comprise three side panels 30, connected at opposite edges to two corner connectors 26. The back of the structure comprises six side panels 30, three high. A straight connector 28 bisects the back of the enclosure with two stacks of three side panels 30 each connected together thereby. The outer edges of the side panels connect into the same rear corner connectors as the sides. The roof or top comprises two of the lid panels 154 and the floor comprises two bottom panels 116. Each door side comprises three stacked panels connected to a front corner connector 26 by the pivot pin members 202 described above. Two nose members 228 are provided, across the lower front edge of the enclosure.

The subject modularity means that the same side panel 30 is used in the formation of the sides and back. Also, the floor panels are identical, reducing the number of molds required to make the component parts. A minimal number of parts need be formed and shipped to the end user. It will be appreciated that assembly of the enclosure as described above is relatively simple and can be accomplished without a large number of fasteners or hand tools. The component parts, moreover, can be shipped disassembled in a "knock-down" state, whereby reducing packaging and shipping costs.

In addition, the panels comprising the enclosure are all preferably formed by the blow molding process. As such, a thickness and strength can be achieved in the resultant hollow panels with minimal use of plastic material. The corner and in-line connectors can effectively join blow molded panels along channels which are necessarily wide due to the manufacturing process. Connectors 26, 28 accomplish such a connection by means of unique U-shaped I-beam ends which fill the wide channels in the panel edge portions. The U-shaped fingers rigidly connect to the panels in a tight manner, and do not detract from the structural integrity of the enclosure.

Moreover, the interlocking detents and detent flanges in the side panels 30 reinforce the sides and back of the enclosure from separation, buckling, racking and weather infiltration. The integrity of the resultant enclosure is enhanced.

While the preferred embodiment shows a utility shed of intermediate proportion, the modularity of the components used therein enable a shed of larger or smaller proportion to be made, if desired, using the same components. By way of example, a larger enclosure can be made by doubling the shed sidewalls to two panels wide, joined by an in-line connector 28. Additional roof panel and floor panels would be required (not shown) but the same side panels 30 as described above may be used. Alternatively, the shed can be made smaller by reducing the sides, front, and back to two panels high. Shorter connectors (not shown) at the corners and inline along the back would be necessary.

Finally, the subject invention has been described in the preferred embodiment as an utility shed. However, the invention need not be so limited. Other applications for enclosures formed by the teachings herein set forth, are intended as well. By way of example, the modular side panels and connector system may be useful in the creation of partitions, fencing, or in the creation of other types of products such as playground activity toys. Other uses and applications, which will be apparent to one skilled in the art, and which utilize the teachings herein set forth, are intended to be within the scope and spirit of the subject invention.

What is claimed is:

1. A construction panel assembly for enclosures, comprising:

a first and a second panel member, the first panel member having a lower edge flange and the second panel member having an upper edge flange which overlap to place the panel members into a stacked and overlapped relationship;

at least one protrusion and at least one recess in the overlapping edge flanges of the first and second panel member which engage to join the overlapping edge flanges together;

a connector strip having a longitudinal channel for receiving lateral edges of the first and second panel members and maintaining the edges in an aligned relationship.

2. A panel assembly according to claim 1, wherein the connector strip comprises a second longitudinal channel for receiving lateral edges of a like-configured third and a fourth panel member.

3. A panel assembly according to claim 1, wherein the connector strip longitudinal channel is defined by spaced-apart sidewalls, at least one of said sidewalls having an inward extending outer edge portion which at least partially encloses an outer side of the channel.

4. A panel assembly according to claim 3, wherein the lateral edges of the first and second panel members are dimensioned for close receipt within the connector strip channel and the first and second panel members further comprise at least one longitudinal slot positioned and dimensioned to receive therein the outer edge portion of the connector strip channel one sidewall.

5. A panel assembly according to claim 4, wherein the outer edge portion of the connector strip channel one sidewall is substantially U-shaped and comprises spaced apart flanges defining therebetween a bight slot.

6. A panel assembly according to claim 5, wherein the flanges are spaced apart a distance substantially equivalent to the width of the one longitudinal slot within the first and second panel members.

7. An enclosure comprising at least one pair of like-configured side panels joined together by an elongate connector, the connector having at least a first longitudinal channel dimensioned to receive a respective lateral edge of each of the side panels and maintain the panels in an aligned relationship, and the first and second panel member each having an edge flange overlapping the edge flange of the opposite panel member and the overlapping edge flanges having at least one protrusion and at least one recess which engage to join the overlapping edge flanges together and;

a roof connected to the side panels and enclosing a top of the enclosure;

a door connected to the side panels and enclosing a forward side of the enclosure.

8. An enclosure according to claim 7, wherein the longitudinal channel is defined by spaced apart sidewalls, and at least one sidewall has a remote edge portion extending inward to at least partially enclose a forward side of the channel.

9. An enclosure according to claim 7, wherein further comprising at least one floor panel having a peripherially located channel for receiving a lower edge portion of at least one of said side panels.

10. An enclosure according to claim 9, wherein the roof comprises at least one roof panel having an underside and engagement means therein for receiving and engaging an upper edge portion of at least one of said side panels.

11. An enclosure according to claim 7, wherein further comprising:

at least one corner connector located at a forward corner of the enclosure and having an elongate channel substantially open along an outward side;

at least one pivot pin member comprising a rearward portion dimensioned for receipt within the corner connector channel and a further comprising a forward portion extending outward from the corner connector channel and the forward portion having an upwardly directed pivot pin affixed thereto;

the door comprising at least one door panel having a bore extending along an outward edge portion dimensioned to receive the pivot pin therein, the door being pivotally supported by the pivot pin member and pivoting about the pivot pin between a closed position and an open position.

12. An enclosure according to claim 11, wherein the corner connector channel is defined by sidewalls, at least one of said sidewalls having an inwardly directed end portion for enclosing at least a portion of said channel outward side, and the pivot pin member rearward portion comprising a slot dimensioned to receive the one sidewall end portion therein to connect the pivot pin member to the corner connector.

13. An enclosure according to claim 7, wherein further comprising:

at least one elongate door connector located at a forward side of the enclosure and having an elongate channel substantially open along an outward side;

a plurality of pivot pin members, each comprising a rearward portion dimensioned for receipt within the door connector channel and further comprising a forward portion extending outward from the connector channel and the forward portion having an upwardly directed upper pivot pin affixed thereto and a downwardly directed lower pivot pin affixed thereto in axial alignment with the upper pivot pin;

the door comprising a plurality of door panels, each having an upper and a lower bore extending along an outward edge portion, the door panels and pivot pin members being alternately positionable along the door connector channel with the upper and lower bores of each said door panel receiving therein the pivot pins of the respective pivot pin members positioned proximate thereto, whereby the door panels are pivotally supported by the pivot pin members and pivot between a closed position and an open position.

14. An enclosure according to claim 13, wherein further comprising a free edge connector connected to forward edge portions of the door panels, the free edge connector comprising an elongate channel dimensioned to receive the forward edge portions of the door panels therein.

15. An enclosure according to claim 14, wherein the free edge connector channel is defined by spaced apart sidewalls and at least one of said sidewalls has an inwardly projecting end portion for at least partially enclosing a forward side of the free edge connector channel; and the door panels each comprise an elongate slot located along said forward edge portions for receiving the end portion of the free edge connector channel one sidewall.

16. An enclosure according to claim 15, wherein the end portion of the free edge connector channel is substantially U-shaped and dimensioned in width to be substantially equivalent to the door panel elongate slot.

17. An enclosure comprising at least one pair of like-configured side panels joined together by an elongate connector, the connector having at least a first longitudinal channel dimensioned to receive a respective lateral edge of each of the side panels and maintain the panels in an aligned relationship;

a roof connected to the side panels and enclosing a top of the enclosure;

a door connected to the side panels and enclosing a forward side of the enclosure;

the longitudinal channel is defined by spaced apart sidewalls, and at least one sidewall has a remote edge portion extending inward to at least partially enclose a forward side of the channel and the remote edge portion is substantially U-shaped and comprises first and second spaced apart flanges defining a bight slot therebetween which opens toward the opposite sidewall.

18. An enclosure according to claim 17, wherein the lateral edge of at least one of the side panels comprises a longitudinal slot sized to closely receive the U-shaped remote edge portion of the connector.

19. A door assembly for an enclosure comprising:

an elongate connector having an elongate channel substantially open along an outward side;

a plurality of pivot pin members, each comprising a rearward portion dimensioned for receipt within the connector channel and further comprising a forward portion extending outward from the connector channel and the forward portion having an upwardly directed upper pivot pin portion affixed thereto and a downwardly directed lower pivot pin portion affixed thereto in axial alignment with the upper pivot pin portion;

a plurality of door panels, each panel having an upper and a lower bore extending along an outward edge portion, the door panels and pivot pin members being alternately positionable along the connector channel with the upper and lower bores of each said door panel receiving therein the pivot pin portions of respective pivot pin members disposed proximate thereto, whereby the door panels are pivotally supported by the pivot pin members and pivot between a closed position and an open position.

20. A door assembly according to claim 19, wherein further comprising a free edge connector connected to forward edge portions of the door panels, the free edge connector comprising an elongate channel dimensioned to receive the forward edge portions of the door panels therein.

21. A door assembly according to claim 20, wherein the free edge connector channel is defined by spaced apart sidewalls and at least one of said sidewalls has an inwardly projecting end portion for at least partially enclosing a forward side of the free edge connector channel; and the door panels each comprise an elongate slot located along said forward edge portions for receiving the end portion of the free edge connector channel one sidewall.

22. A door assembly according to claim 21, wherein the end portion of the free edge connector channel is substantially U-shaped and dimensioned in width to be substantially equivalent to the door panel elongate slot.

* * * * *